US009383715B2

(12) United States Patent
Honjoh et al.

(10) Patent No.: US 9,383,715 B2
(45) Date of Patent: Jul. 5, 2016

(54) LUBRICANT SUPPLYING DEVICE, PROCESS CARTRIDGE AND IMAGE FORMING APPARATUS

(71) Applicants: Kenji Honjoh, Fujisawa (JP); Takeshi Shintani, Kawasaki (JP); Nobuo Kuwabara, Yokohama (JP); Yasuhiro Maehata, Hachioji (JP); Yasuhito Kuboshima, Hachioji (JP); Yusuke Ishizuka, Yokohama (JP)

(72) Inventors: Kenji Honjoh, Fujisawa (JP); Takeshi Shintani, Kawasaki (JP); Nobuo Kuwabara, Yokohama (JP); Yasuhiro Maehata, Hachioji (JP); Yasuhito Kuboshima, Hachioji (JP); Yusuke Ishizuka, Yokohama (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/935,021

(22) Filed: Nov. 6, 2015

(65) Prior Publication Data

US 2016/0139555 A1 May 19, 2016

(30) Foreign Application Priority Data

Nov. 14, 2014 (JP) ..... 2014-231730
May 28, 2015 (JP) ..... 2015-109064

(51) Int. Cl.
*G03G 21/00* (2006.01)

(52) U.S. Cl.
CPC ..... *G03G 21/0094* (2013.01)

(58) Field of Classification Search
CPC ..... G03G 21/0094
USPC ..... 399/346
See application file for complete search history.

(56) References Cited

U.S. PATENT DOCUMENTS

| | | | |
|---|---|---|---|
| 7,894,758 | B2 | 2/2011 | Shintani et al. |
| 7,929,875 | B2 | 4/2011 | Nishida |
| 7,953,363 | B2 | 5/2011 | Honjoh et al. |
| 8,041,280 | B2 | 10/2011 | Koike et al. |
| 8,095,059 | B2 | 1/2012 | Shintani et al. |
| 8,204,423 | B2 | 6/2012 | Hatori et al. |
| 8,380,115 | B2 | 2/2013 | Shintani et al. |
| 8,396,383 | B2 | 3/2013 | Honjoh et al. |
| 8,577,257 | B2 | 11/2013 | Arai et al. |
| 8,712,261 | B2 | 4/2014 | Kudo et al. |
| 8,718,530 | B2 | 5/2014 | Kudo et al. |

(Continued)

FOREIGN PATENT DOCUMENTS

| | | |
|---|---|---|
| JP | H08-146842 | 7/1996 |
| JP | 2009-008800 | 1/2009 |

(Continued)

*Primary Examiner* — David Bolduc
*Assistant Examiner* — Barnabas Fekete
(74) *Attorney, Agent, or Firm* — Oblon, McClelland, Maier & Neustadt, L.L.P.

(57) ABSTRACT

A lubricant supplying device includes a lubricant supplier contacting an image bearer, a solid lubricant contacting the roller, a detector detecting a lubricant amount, and a controller controlling a supplying of the roller based on a detector detection. The detector outputs to the controller a first signal of a near-end state when the amount reaches a first amount, a second signal of an end state when the amount reaches a second amount smaller than the first amount, and a third signal of an absolute end state when the amount reaches a third amount smaller than the second amount. The controller temporarily stops the supplying when the second signal is output, cancels a roller temporary stopped state even when lubricant replacement is not completed after this state, stops the supplying when the third signal is output, and maintains a roller stopped state until the replacement is completed after this state.

20 Claims, 7 Drawing Sheets

(56) References Cited

U.S. PATENT DOCUMENTS

| | | | |
|---|---|---|---|
| 8,761,654 | B2 | 6/2014 | Kawahara et al. |
| 8,855,507 | B2 | 10/2014 | Seki et al. |
| 9,037,038 | B2 | 5/2015 | Karasawa et al. |
| 9,052,669 | B2 | 6/2015 | Tomita et al. |
| 9,068,693 | B2 | 6/2015 | Hatori et al. |
| 9,081,347 | B2 | 7/2015 | Fujimori et al. |
| 9,122,225 | B2 | 9/2015 | Uenishi et al. |
| 9,128,452 | B2 | 9/2015 | Hatori et al. |
| 9,146,517 | B2 | 9/2015 | Honjoh et al. |
| 2014/0270881 | A1 | 9/2014 | Gotoh et al. |
| 2015/0078795 | A1 | 3/2015 | Kuwabara et al. |

FOREIGN PATENT DOCUMENTS

| | | |
|---|---|---|
| JP | 2011-028202 | 2/2011 |
| JP | 2013-020232 | 1/2013 |

LUBRICANT SUPPLYING DEVICE, PROCESS CARTRIDGE AND IMAGE FORMING APPARATUS

CROSS-REFERENCE TO RELATED APPLICATIONS

This patent application is based on and claims priority pursuant to 35 U.S.C. §119(a) to Japanese Patent Application No. 2014-231730, filed on Nov. 14, 2014, and to Japanese Patent Application No. 2015-109064, filed on May 28, 2015, in the Japan Patent Office. The entire contents of each of the above applications are hereby incorporated by reference herein.

BACKGROUND

1. Technical Field

The present invention relates to electrophotographic image forming apparatuses, such as photocopiers, printers, facsimiles, or multifunctional machines having image forming capabilities, which include a lubricant supplying device and process cartridge.

2. Description of the Related Art

For use in image forming apparatuses such as photocopiers and printers, techniques have been known that use lubricant supplying devices for supplying lubricant onto image bearers such as photosensitive drums and intermediate transfer belts.

In an example of such copying machines, non-transferred toner remaining on the photosensitive drum after a transfer process needs to be completely removed by a cleaning blade (cleaning device) making contact with the photosensitive drum. However, when abrasion occurs at the contact portion of the cleaning blade due to friction with the photosensitive drum, the non-transferred toner passes through a gap, due to abrasion, between the cleaning blade and the photosensitive drum, thereby causing a cleaning failure due to the passed-through non-transferred toner or filming (fusion) of the passed-through non-transferred toner onto the photosensitive drum.

For addressing such problems, the lubricant supplying devices apply the lubricant onto the photosensitive drum to reduce a friction coefficient on the photosensitive drum, thereby lessening wear and abrasion of the cleaning blade and the deterioration of the photosensitive drum. As a result, cleaning failure and filming occurring over time can be suppressed.

However, in the conventional lubricant supplying devices, when an end state of a solid lubricant is detected, the lubricant supplying devices are controlled not to perform an operation until replacement maintenance of the solid lubricant is completed. Then, an application of the lubricant onto the photosensitive drum and an image forming operation are interrupted. This interruption causes a big down time for users.

An object of the present invention is to provide an image forming apparatus, which includes a lubricant supplying device and a process cartridge for reducing the down time caused by the replacement maintenance of the solid lubricant even when the end state of the solid lubricant is detected.

SUMMARY

In view of the foregoing, in an aspect of this disclosure, there is provided a lubricant supplying device for supplying a lubricant on an image bearer supporting a toner image, which includes a lubricant supplying roller that makes a sliding contact with the image bearer rotating in a predetermined direction, a solid lubricant that makes a sliding contact with the lubricant supplying roller, a residual amount detector that detects a residual amount of the solid lubricant, and a controller that is configured to control a supplying operation of the lubricant supplying roller based on a detection result detected by the residual amount detector. The residual amount detector is configured to output a first signal that informs the solid lubricant is in a near-end state to the controller when the residual amount of the solid lubricant reaches a first predetermined amount, and to output a second signal that informs the solid lubricant is in an end state to the controller when the residual amount of the solid lubricant reaches a second predetermined amount that is smaller than the first predetermined amount, and to output a third signal that informs the solid lubricant is in an absolute end state to the controller when the residual amount of the solid lubricant reaches a third predetermined amount that is smaller than the second predetermined amount. The controller is configured to temporarily stop the supplying operation of the lubricant supplying roller when the residual amount detector outputs the second signal, and to cancel a temporary stopped state of the lubricant supplying roller by a predetermined operation even if a replacement of the solid lubricant is not completed after the temporary stopped state, and to stop the supplying operation of the lubricant supplying roller when the residual amount detector outputs the third signal, and to maintain the stopped state until the replacement of the solid lubricant is completed after the stopped state.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, of which.

DETAILED DESCRIPTION

Figure 1:
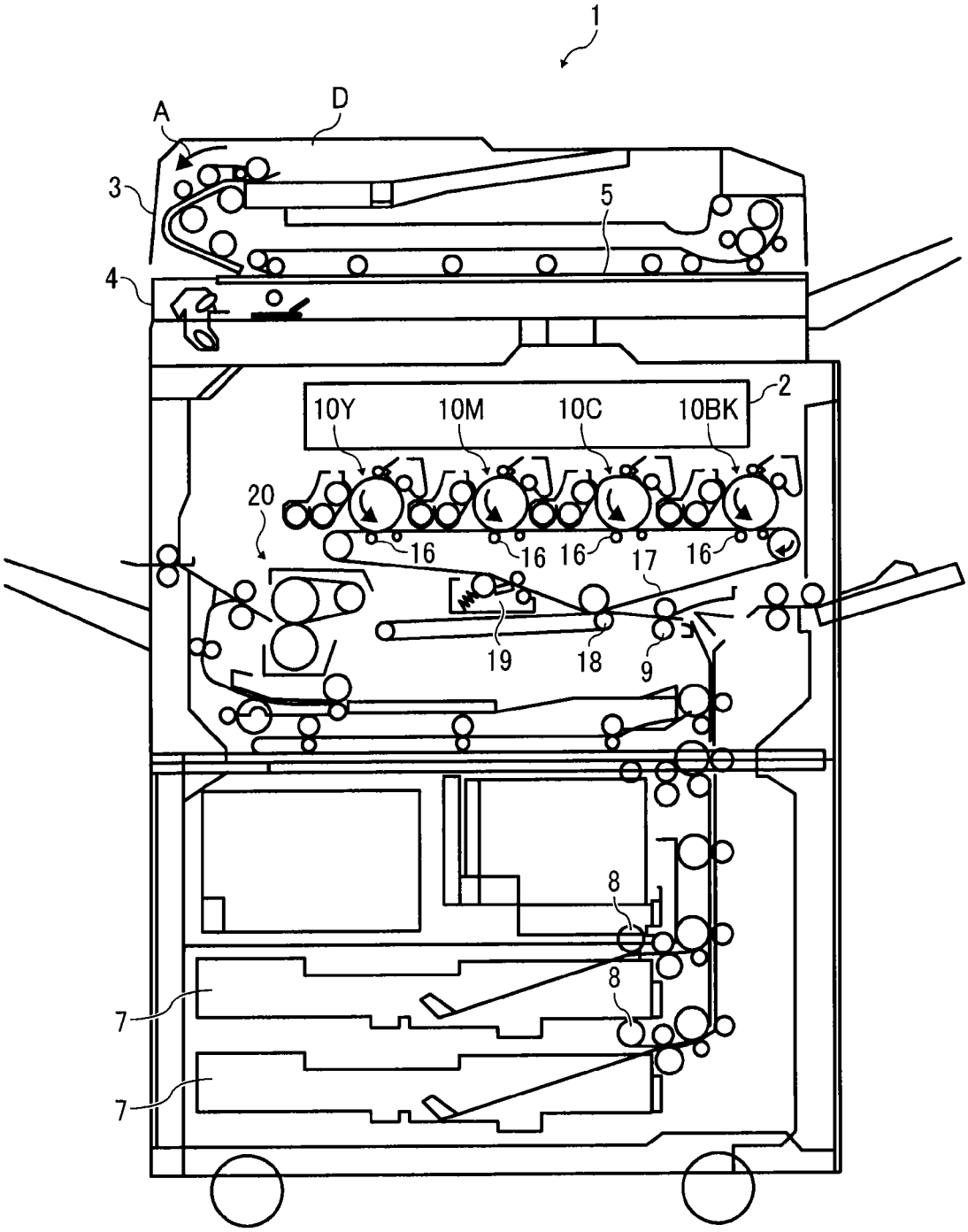
FIG. 1 is a vertical cross-sectional view illustrating an example of a configuration of the image forming apparatus according to an embodiment of a present disclosure.

Various embodiments of the present invention will be described below with reference to the accompanying drawings. In the descriptions of the embodiments, the same components or components with the same functions are denoted by the same reference symbols, and the same explanation will not be repeated in subsequent embodiments. The descriptions below are mere examples and do not limit the scope of the appended claims. Further, a person skilled in the art may easily conceive other embodiments by making modifications or changes within the scope of the appended claims, however, such modifications and changes obviously fall within the scope of the appended claims. In the drawings, Y, M, C, and K are symbols appended to components corresponding to yellow, magenta, cyan, and black, respectively, and will be omitted appropriately.

Referring now to the drawings, wherein like reference numerals designate identical or corresponding parts throughout the several views, exemplary embodiments of the present patent application are described. The first, a preliminary matter of the present invention for help of understanding is explained below.

A configuration and operation of a full-color copier serving as an image forming apparatus 1 according to an illustrative embodiment are described in detail below. FIG. 1 is a vertical cross-sectional view illustrating an example of a configuration of the image forming apparatus 1.

It is to be noted that a process cartridge is hereinafter defined as a unit in which a photoconductor and at least one of a charger that charges the photoconductor, a developing device that develops a latent image formed on the photoconductor, and a cleaning device that cleans the photoconductor are formed as a single integrated unit, and is detachably attachable to an image forming apparatus.

The image forming apparatus 1 also includes a write scanner 2, a document feeder 3, a read scanner 4, a platen glass 5, sheet feeders 7 with feed rollers 8, a pair of registration rollers 9, multiple primary transfer rollers 16, an intermediate transfer belt 17, a secondary transfer roller 18, a belt cleaner 19, and an fixing device 20.

Full-color image formation performed by the image forming apparatus 1 is described in detail below.

The document D set on a document stand is conveyed by conveyance rollers provided to the document conveyance unit 3 in a direction indicated by an arrow A in FIG. 1 to be placed on the platen glass 5 provided to the document reading unit 4. The document read scanner 4 optically reads image data of the document D thus placed on the platen glass 5.

Specifically, the document read scanner 4 scans an image of the document D with light emitted from a lamp. Light reflected from the document D is focused on a color sensor via a group of mirrors and lenses. Color image data of the document D is read by the color sensor separately for color separation components red (R), green (G), and blue (B), and then is converted into electrical signals. In addition, an image processing unit, performs color conversion, color correction, spatial frequency correction, and so forth on the image data based on the image signals of R, G, and B to obtain color image data of yellow (Y), magenta (M), cyan (C), and black (K).

The image data of yellow (Y), magenta (M), cyan (C), and black (K) is sent to the optical writing unit 2. The optical writing unit 2 directs laser light L onto the surfaces of photoconductors 11 provided in corresponding process cartridges 10Y, 10M, 10C, and 10BK based on the image data of the respective colors.

Figure 2:
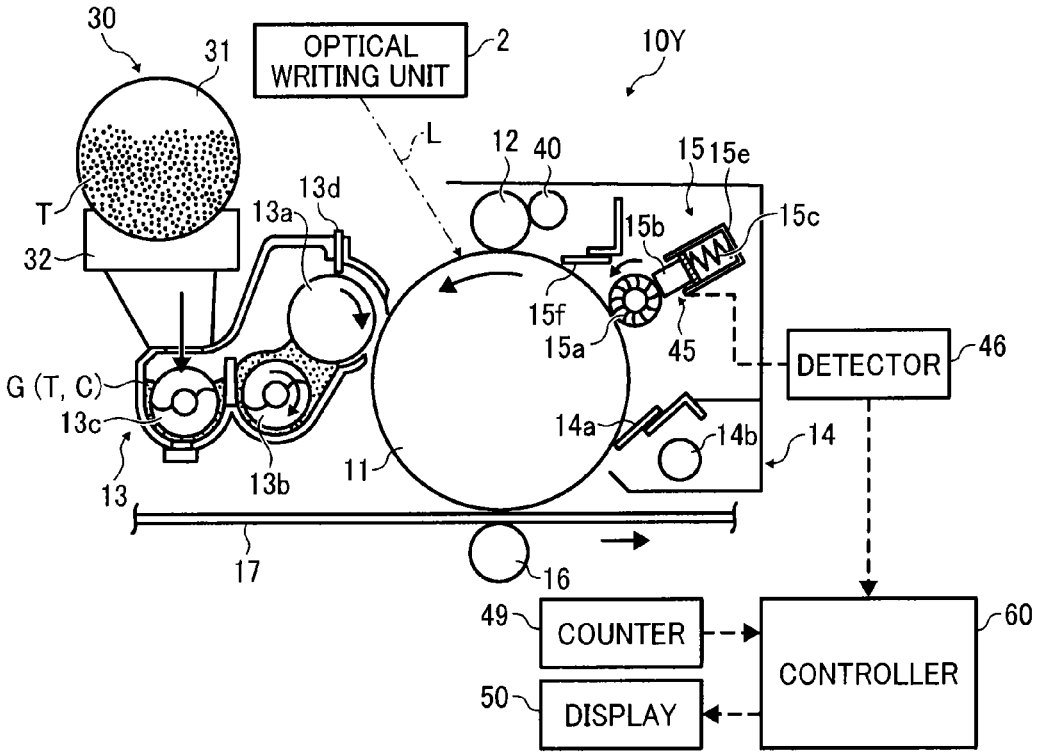
FIG. 2 is a vertical cross-sectional view illustrating an example of a configuration of one of the process cartridges, according to an embodiment of a present disclosure, provided to the image forming apparatus.

The photoconductors 11 are rotated in a counter clockwise direction in FIG. 2. The surfaces of the photoconductors 11 are evenly charged by chargers 12 at a position where the surfaces of the photoconductors 11 face the chargers 12, respectively (CHARGING PROCESS). The charged surfaces of the photoconductors 11 reach a position onto which the laser light L of the specified color is directed from the optical writing unit 2, respectively. At that time, the laser light L each corresponding to the image signal of the specified color is emitted from a light source of the optical writing unit 2. The laser light L follows optical paths for each color component of yellow (Y), magenta (M), cyan (C), or black (K), respectively (EXPOSING PROCESS).

Specifically, the laser light L corresponding to the color component of yellow (Y) is reflected from mirrors, and then is directed onto the surface of the photoconductor 11Y. At this time, the laser light L corresponding to the color component of yellow (Y) scans in a direction of a rotary shaft of the photoconductor 11Y, that is, a main scanning direction, using the polygon mirror rotated at high speed. Accordingly, an electrostatic latent image of yellow (Y) is formed on the charged surface of the photoconductor 11Y.

Similarly, the laser light L corresponding to the color component of magenta (M) is reflected from mirrors, and then is directed onto the surface of the photoconductor 11M. Thus, the electrostatic latent image of magenta (M) is formed on the charged surface of the photoconductor 11M. The laser light L corresponding to the color component of cyan (C) is reflected from mirrors, and then is directed onto the surface of the photoconductor 11C. Thus, the electrostatic latent image of cyan (C) is formed on the charged surface of the photoconductor 11C. The laser light L corresponding to the color component of black (K) is reflected from a mirror, and then is directed onto the surface of the photoconductor 11K. Thus, the electrostatic latent image of black (K) is formed on the charged surface of the photoconductor 11K.

The electrostatic latent images thus formed on the surfaces of the photoconductors 11 reach the developing devices 13, respectively, as the photoconductors 11 rotate. The developing devices 13 supply toner of the specified colors to the surfaces of the photoconductors 11 to develop the electrostatic latent images with the toner, respectively. Accordingly, toner images of the specified colors are formed on the surfaces of the photoconductors 11, respectively (DEVELOPING PROCESS).

The toner images thus formed on the surfaces of the photoconductors 11 rotate and are conveyed to primary transfer positions where the photoconductors 11 face the intermediate transfer belt 17. At the primary transfer positions, the primary transfer rollers 16 are provided to contact an inner circumferential surface of the intermediate transfer belt 17. The primary transfer rollers 16 primarily transfer the toner images from the surfaces of the photoconductors 11 onto the intermediate transfer belt 17. As a result, the toner images are sequentially superimposed one atop the other to form a full-color toner image on the intermediate transfer belt 17 (PRIMARY TRANSFER PROCESS).

The surfaces of the photoconductors 11 from which the toner images are primarily transferred onto the intermediate transfer belt 17 reach the cleaning devices 14, respectively, as the photoconductors 11 further rotate. At this position, a cleaning blade 14*a* of the cleaning devices 14 mechanically removes extraneous substances such as non-transferred toner remaining attached to the photoconductors 11 without being transferred onto the intermediate transfer belt 17 from the surfaces of the photoconductors 11, respectively. Then, the extraneous substances are accommodated in the cleaning devices 14 (CLEANING PROCESS). After that, the extraneous substances are conveyed to a waste toner container with a conveying screw 14*b*.

Thereafter, the surfaces of the photoconductors 11 pass a lubricant supplying device 15, and are neutralized by neutralizing devices, to complete one image formation sequence performed by the photoconductors 11.

Meanwhile, the intermediate transfer belt 17 bearing the full-color toner image is rotated in a clockwise direction in FIG. 1 so that the full-color toner image reaches the secondary transfer roller 18. The secondary transfer roller 18 secondarily transfers the full-color toner image from the intermediate transfer belt 17 onto a recording medium (SECONDARY TRANSFER PROCESS). Thereafter, a portion of the intermediate transfer belt 17 from which the full-color toner image is secondarily transferred onto the recording medium reaches the belt cleaning device 19. The belt cleaning device 19 collects non-transferred toner remaining attached to the intermediate transfer belt 17 without being transferred onto the recording medium to complete one transfer sequence performed by the intermediate transfer belt 17.

It is to be noted that the recording medium is conveyed to the secondary transfer roller 18, where there is a secondary transfer nip, from the sheet feeder 7 via a conveyance guide, the pair of registration rollers 9, and so on. Specifically, the recording medium stored in the sheet feeder 7 is fed by the sheet feed roller 8, and is conveyed to the pair of registration rollers 9 via the conveyance guide. The recording medium is then conveyed to the secondary transfer nip by the pair of registration rollers 9 in synchronization with the full-color toner image formed on the intermediate transfer belt 17 so that the full-color toner image is secondarily transferred onto the recording medium by the secondary transfer roller 18.

The recording medium having the full-color toner image thereon is then conveyed to the fixing device 20 by the conveyance belt. In the fixing device 20, the full-color toner image is fixed onto the recording medium by a heating belt and a pressing roller, between which both the recording medium passes (FIXING PROCESS). Further, the fixing device 20 can provide for a heating roller, and so on, instead of the heating belt.

Thereafter, the sheet P having the fixed full-color toner image thereon is discharged from the image forming apparatus 1 by an ejection roller, completing the image formation sequence.

A description is now given of process cartridges 10Y, serving as image forming units, provided in the image forming apparatus 1 with reference to FIG. 2. FIG. 2 is a vertical cross-sectional view illustrating an example of a configuration of one of the process cartridges provided to the image forming apparatus 1.

It is to be noted that each of the four process cartridges provided to the image forming apparatus 1 has the same basic configuration, differing only in the color of toner used. Therefore, only one of the image forming units is shown as a representative example without the suffixes Y, M, C, and K each representing the color of toner in FIG. 2 and subsequent drawings.

As illustrated in FIG. 2, each of the process cartridges 10 integrally accommodates the photoconductor 11 serving as an image bearer, the charger 12 (charging roller), the developing device 13 (developing component), the cleaning device 14 (cleaning component), and the lubricant supplying device 15. In this embodiment, each of the process cartridges is detachably attached to the image forming apparatus 1 in a longitudinal direction thereof, which is a same direction as a direction perpendicular to a paper surface direction of FIG. 2, and is replaceable. In this configuration, each of the process cartridges 10 is detached to replace a new one, and to fix each.

Each of the photoconductors 11 is a negatively charged organic photoreceptor in which a photosensitive layer is provided on a drum-type conductive support. Specifically, an insulative undercoat layer, an electrical charge generation layer serving as the photosensitive layer, an electrical charge transport layer, and a protection layer serving as a top layer are sequentially laminated on the conductive support serving as a base layer to construct each of the photoconductors 11. The photoconductors 11 are rotated in the counter clockwise direction in FIG. 2 by a driving motor.

Referring FIG. 2, the charger 12 is a charging roller composed of a conductive cored bar and a mid-resistance elastic layer coated on the conductive cored bar, and is disposed downstream from the lubricant supplying device 15 in the rotational direction of the photoconductor 11. A certain voltage (charging bias), which is an AC voltage superimposed on a DC voltage, is applied to the charger 12 from a power source, thereby uniformly charging the surface of the photoconductor 11 facing the charger 12.

The charger 12 is disposed so as to make contact with the photoconductor 11 biased by a spring. It is possible to be disposed so as to face the photoconductor 11 without making contact with the photoconductor 11. Further, it is possible to apply a DC voltage as a charging voltage, instead of applying the certain voltage which is an AC voltage superimposed on a DC voltage.

Furthermore, a charger cleaning roller 40, which cleans a surface of the charger 12, is disposed so as to make contact with the charger 12.

The developing device 13 mainly includes a developing roller 13*a* facing the photoconductor 11, a first conveyor screw 13*b* facing the developing roller 13*a*, a second conveyor screw 13*c* facing the first conveyor screw 13*b* with a partition interposed therebetween, and a doctor blade 13*d* facing the developing roller 13*a*. The developing roller 13*a* includes magnets fixed inside thereof so as to form magnetic poles on the circumferential surface thereof, and a sleeve rotating around the magnets. The magnets form magnetic poles on the developing roller 13*a* (the sleeve). As a result, developer G is carried on the developing roller 13*a*.

The developing device 13 contains a two-component type developer G composed of carrier particles C and toner T.

The cleaning device 14 is disposed upstream from the lubricant supplying device 15 in the rotational direction of the photoconductor 11. The cleaning device 14 includes the cleaning blade 14*a* that entirely makes contact with the photoconductor 11 in the longitudinal direction of the photoconductor 11, and that scrapes the surface of the photoconductor 11. The cleaning device 14 includes the conveying screw 14*b* that conveys the extraneous substances collected inside the cleaning device 14 as waste toner toward the waste toner container in a width direction of the cleaning blade 14*a*

(which is the same direction as the direction perpendicular to a paper surface direction of FIG. 2).

The cleaning blade 14*a* is made of a rubber material such as urethane rubber and makes contact with the surface of the photoconductor 11 at a certain angle and a certain pressure. As a result, an adhesion substance such as non-transferred toner adhering to the photoconductor 11 is mechanically scraped and collected inside the cleaning device 14. Examples of adhesion substances adhering to the photosensitive drum 11, in addition to the non-transferred toner, include paper powder produced from the recording medium (sheet), discharge products produced on the photoconductor 11 during discharge of the roller charging device 12, and additives added to the toner.

In this embodiment, a free end of the cleaning blade 14*a* is disposed upstream side in the rotational direction of the photoconductor 11 so as to make contact with the photoconductor 11 in the direction opposite the rotational direction of the photoconductor 11 (in a counter direction).

As illustrated in FIG. 2 and FIGS. 3A to 3D, the lubricant supplying device 15 includes a lubricant supplying roller 15*a* serving as a lubricant supplier having a foam elastic layer that makes a sliding contact with the photoconductor 11, a solid lubricant 15*b* that makes a sliding contact with the foam elastic layer of the lubricant supplying roller 15*a*, a compression spring 15*c* that urges the solid lubricant 15*b* toward the lubricant supplying roller 15*a*, a supporter 15*d* (supporting plate) that supports the solid lubricant 15*b*, a guide 15*e* (holder) that guides the solid lubricant 15*b* urged by the compression spring 15*c* and supported by supporter 15*d*, plate springs 45 serving as a conductive member that is disposed at both ends in the longitudinal direction, and a level blade 15*f* (blade) that uniformly makes thin layers of the lubricant supplied on the photoconductor 11 by contacting entirely in the longitudinal direction.

The lubricant supplying device 15 is disposed on a downstream side in the rotational direction of the photoconductor 11 with respect to the cleaning blade 14*a* of the cleaning device 14 and is disposed on an upstream side in the rotational direction of the photoconductor 11 with respect to the charger 12. The level blade 15*f* is disposed downstream from the lubricant supplying roller 15*a* in the rotational direction of the photoconductor 11.

A detailed description is now given of a construction of the lubricant supplying roller 15*a*.

The lubricant supplying roller 15*a* is a roller constructed of a metal shaft (e.g., a metal core) and the elastic foam layer coating the metal shaft and made of polyurethane foam or urethane foam. As the elastic foam layer of the lubricant supplying roller 15*a* in contact with the outer circumferential surface of the photoconductor 11 rotates counterclockwise in FIG. 2, the lubricant supplying roller 15*a* applies the lubricant scraped off the solid lubricant 15*b* to the photoconductor 11.

A description is provided of a method for manufacturing the lubricant supplying roller 15*a*.

Polyurethane foam to be produced into the elastic foam layer is formed into a block. The block is cut into a primary piece having a given shape and its surface is ground. A core (e.g., a metal core) to be produced into the shaft is inserted into the primary piece of polyurethane foam. As the primary piece of polyurethane foam is rotated, a grind blade in contact with the primary piece moves parallel to an axial direction of the metal core until the grind blade cuts the primary piece into a sponge having a given thickness by traverse grinding. Thus, the elastic foam layer is manufactured. Before the metal core is inserted into the primary piece of polyurethane foam, an adhesive may be applied to the metal core to facilitate adhesion of the metal core to the primary piece. Further, during traverse grinding, the rotation speed of the primary piece of polyurethane foam and the moving speed of the grind blade may be changed to produce uneven surface asperities on the elastic foam layer. The method for manufacturing the lubricant application roller 15*a* is not limited to the above. For example, alternatively, a polyurethane foam material is injected into a mold accommodating the metal core and foamed and hardened.

A detailed description is now given of a configuration of the lubricant supplying roller 15*a*.

As shown in FIG. 2, the lubricant supplying roller 15*a* rotates in the counterclockwise direction, that is, a counter direction at a contact point where the lubricant supplying roller 15*a* contacts the photoconductor 11 rotating counterclockwise in the rotation direction such that the lubricant supplying roller 15*a* slides over the photoconductor 11. The lubricant supplying roller 15*a* slides over the solid lubricant 15*b* and the photoconductor 11. As the lubricant supplying roller 15*a* rotates in the rotational direction thereof, the lubricant supplying roller 15*a* scrapes a lubricant off the solid lubricant 15*b* and applies the scraped lubricant onto the photoconductor 11. The compression spring 15*c* is disposed opposite the lubricant supplying roller 15*a* via the supporter 15*d* and the solid lubricant 15*b*. The compression spring 15*c* is anchored to the guide 15*e* and the supporter 15*d* to bias and press the solid lubricant 15*b* against the lubricant supplying roller 15*a*, thus bringing the solid lubricant 15*b* into even contact with the lubricant supplying roller 15*a*.

A detailed description is now given of a configuration of the solid lubricant 15*b*.

The solid lubricant 15*b* is made of aliphatic acid zinc metal containing an inorganic lubricant. For example, the aliphatic acid zinc metal may contain at least zinc stearate. The inorganic lubricant may contain at least one of talc, mica, and boron nitride. The zinc stearate may be typical lamella crystalline powder. Lamella crystal has a self-assembled layer structure produced with an amphipathic molecule. Accordingly, as the lamella crystal receives a shear force, it may be broken along an interlayer and subject to slippage. Consequently, the lamella crystal applied on the outer circumferential surface of the photoconductor 11 decreases friction between the photoconductor 11 and a component or a substance sliding thereover. Since the lamella crystal, upon receiving a shear force, spreads over and coats the outer circumferential surface of the photoconductor 11 evenly, the lubricant containing the lamella crystal, even with a small amount thereof, coats the outer circumferential surface of the photoconductor 11 effectively. Accordingly, the lubricant coats the outer circumferential surface of the photoconductor 11 relatively evenly, protecting the photoconductor 11 against electrical stress during the charging process precisely. The inorganic lubricant having a plated structure such as talc, mica, and boron nitride prevents the toner and the lubricant from passing under the cleaning blade 14*a* and reaching and staining the charger 12.

A description is provided of a method for manufacturing the solid lubricant 15*b*.

Dissolved powder is put into a mold and compressed, thus being solidified into a substantial prism. The method simplifies production facility, resulting in reduced manufacturing costs.

A detailed description is now given of a configuration of the level blade 15*f*.

The level blade 15*f* is a plate made of rubber such as urethane rubber and in contact with the outer circumferential surface of the photoconductor 11 at a given angle and a given pressure therebetween. The level blade 15*f* is disposed downstream from the cleaning blade 14*a* in the rotation direction of the photoconductor 11. The level blade 15*f* levels the lubricant supplied from the lubricant supplying roller 15*a* onto the photoconductor 11 into a thin lubricant layer that coats the photoconductor 11 evenly with a proper amount. As the lubricant supplying roller 15*a* applies the lubricant scraped off the solid lubricant 15*b* onto the outer circumferential surface of the photoconductor 11, the photoconductor 11 bears a powdery lubricant that lubricates the photoconductor 11 insufficiently. To address this circumstance, the level blade 15*f* levels the powdery lubricant into the thin lubricant layer. Thus, the level blade 15*f* produces the thin lubricant layer that coats and lubricates the photoconductor 11. That is, the powdery lubricant that lubricates the photoconductor 11 insufficiently is transformed into the thin lubricant layer that lubricates the photoconductor 11 sufficiently.

The level blade 15*f* is directed to and brought into contact with the outer circumferential surface of the photoconductor 11 in a direction trailing to the rotational direction of the photoconductor 11.

The two separate blades, that is, the cleaning blade 14*a* and the level blade 15*f*, contact the photoconductor 11 to clean and lubricate the photoconductor 11 precisely. The lubricant supplied to the photoconductor 11 reduces abrasion and wear of the cleaning blade 14*a* and the level blade 15*f* caused by friction between the photoconductor 11 and the cleaning blade 14*a* and friction between the photoconductive drum 11 and the level blade 15*f*.

Referring FIGS. 3A to 3D, the lubricant supplying device 15 according to the embodiment of the present disclosure includes the plate springs 45 that are formed of a conductive material (e.g., a metal), and that are serving as elastic engaging members. The plate springs 45 are disposed at the guide 15*e* (holder) that guides a slide movement of the supporter 15*d* toward the lubricant supplying roller 15*a*. The plate springs 45 are disposed at both end sides of the process cartridge 10Y in the attaching direction (corresponding to the longitudinal direction of the process cartridge 10Y). By this configuration, a size of the plate springs 45 is made smaller, and a cost of the lubricant supplying device 15 is made lower. Further, because the plate springs 45 are disposed at both end sides of the process cartridge 10Y, the solid lubricant 15*b* is consumed evenly and with no inclination to one side.

The supporter 15*d*, which is formed of a conductive material (e.g., a metal), displaces toward the lubricant supplying roller 15*a* with consumption of the solid lubricant 15*b*. Consequently, the supporter 15*d* makes contact with the plate springs 45 (conductive member), and then, a signal of a conduction state is outputted to a detector 46 shown in FIG. 2 (conduction detector). Subsequently, by detecting the conduction state between the supporter 15*d* and the plate springs 45, a near-end state is detected. How to detect the near-end state is described after in more detail.

With reference to FIG. 2, a detailed description is now given of the image forming processes described above.

The developing roller 13*a* rotates in the clockwise direction in FIG. 2. As the first conveyor screw 13*b* and the second conveyor screw 13*c* disposed opposite the first conveyor screw 13*b* via the partition rotate, they circulate the developer G accommodated inside the developing device 13 in a longitudinal direction of the first conveyor screw 13*b* and the second conveyor screw 13*c* parallel to an axial direction thereof while the developer G is agitated and mixed with fresh toner T supplied from a toner supplier 30 through a toner inlet.

The toner T attracted to carrier particles C by frictional charging, together with the carrier particles C, move onto the developing roller 13*a*. As the developing roller 13*a* rotates, the developer G containing the toner T and the carrier particles C carried by the developing roller 13*a* reaches the doctor blade 13*d*. After the doctor blade 13*d* adjusts an amount of the developer G carried by the developing roller 13*a*, the developer G reaches the development position where the developing roller 13*a* is disposed opposite the photoconductor 11.

At the development position, the toner T contained in the developer G adheres to the electrostatic latent image formed on the outer circumferential surface of the photoconductor 11. For example, an electrostatic latent image potential, that is, an exposure potential, created by a laser beam L irradiating the photoconductor 11 and a developing bias applied to the developing roller 13*a* produce a potential difference, that is, a developing potential, that creates an electric field. The electric field causes the toner T to adhere to the electrostatic latent image formed on the photoconductor 11, thus visualizing the electrostatic latent image into a toner image.

The toner T adhered to the photoconductor 11 during the developing process is mostly primarily transferred onto the intermediate transfer belt 17. Conversely, residual toner T failing to be transferred onto the intermediate transfer belt 17 and therefore remaining on the photoconductor 11 is removed and collected by the cleaning blade 14*a* into the cleaning device 14. Thereafter, the outer circumferential surface of the photoconductor 11 passes through the lubricant supplying device 15 and the neutralizing devices successively. Thus, a series of image forming processes performed on the photoconductor 11 is completed.

A detailed description is now given of a construction of the toner supplier 30.

The toner supplier 30 located inside the image forming apparatus 1 depicted in FIG. 1 includes a toner bottle 31 detachably attached to the image forming apparatus 1 for replacement in the longitudinal direction thereof and a toner hopper 32 that drives and rotates the toner bottle 31 while supporting it to replenish the development device 13 with fresh toner T. For example, the toner bottle 31 connected to the development device 13 of the process cartridge 10Y shown in FIG. 2 contains fresh yellow toner T. The toner bottle 31 includes a spiral projection on an inner circumferential surface thereof. As the toner bottle 31 rotates, the toner accommodated inside thereof is conveyed in the longitudinal direction.

As the toner T contained in the developing device 13 is consumed, fresh toner T contained in the toner bottle 31 is supplied into the developing device 13 through the toner inlet as appropriate. Consumption of the toner T contained in the developing device 13 is detected by a magnetic sensor situated below the second conveyor screw 13*c* of the developing device 13 directly.

A detailed description is now given of a construction and a operation of the lubricant supplying device 15.

The lubricant supplying device 15 is configured to be able to replace the solid lubricant 15*b* by detaching and attaching the guide 15*e* (holder).

In more detail, in a detachment state of the process cartridge 10Y from the image forming apparatus 1, a mounting space where the solid lubricant 15*b* is attached is exposed by detaching the guide 15*e* and the plate springs 45. After that, the solid lubricant 15*b* is replaced with a new one. Then, although the supporter 15*d* and the compression spring 15*c* is detached with the solid lubricant 15*b*, at least one of the supporter 15*d* and the compression spring 15*c* can be recycled.

Further, the image forming apparatus 1 includes a set detecting sensor, for example push switch, which detects an attachment state of the process cartridge 10Y. By the set detecting sensor, the image forming apparatus 1 detects whether the process cartridge 10Y is attached. By this configuration, the image forming apparatus can't operate in a state which is a detachment state of the process cartridge 10Y, that is, a state in which the process cartridge 10Y is not attached.

Further, the lubricant supplying device 15 includes a residual amount detector (residual amount detecting member) which detects a residual amount of the solid lubricant 15*b*. Further, a detailed configuration of the residual amount detector is described below.

Figure 3A:
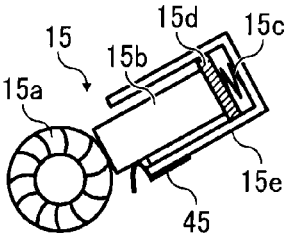
FIGS. 3A to 3D are schematic diagrams illustrating a residual amount of a solid lubricant employed in a lubricant supplying device, and the residual amount of the solid lubricant is gradually reduced from FIGS. 3A to 3D.
Figure 3B:
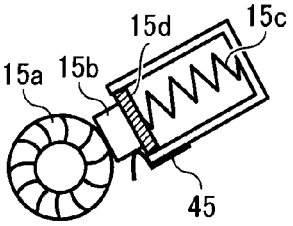
Figure 3C:
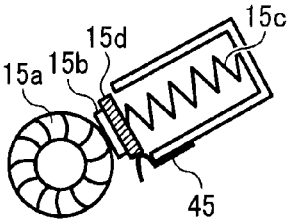
Figure 3D:
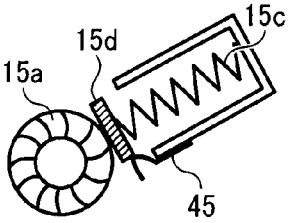

When a state that the residual amount of the solid lubricant 15*b* reaches a first predetermined amount is detected by the residual amount detector, "a near-end state" that the residual amount of the solid lubricant 15*b* is a small amount, as shown in FIG. 3B, is informed by outputting a control signal. Then, a request to prepare a maintenance, which is a replacement of the process cartridge 10Y or a replacement of the solid lubricant 15*b*, is informed by outputting a control signal. Further, when a state that the residual amount of the solid lubricant 15*b* reaches a second predetermined amount is detected by the residual amount detector, "an end state" that the residual amount of the solid lubricant 15*b* is almost nothing, as shown in FIG. 3C, is informed by outputting a control signal. The second predetermined amount is a smaller amount than the first predetermined amount in terms of the residual amount of the solid lubricant 15*b*. Then, the request of the maintenance is informed by outputting a control signal. Subsequently, the lubricant supplying roller 15*a* of the lubricant supplying device 15 and an operation of the image forming apparatus 1 are controlled to be temporarily stopped. After that, even if the maintenance is not completed, based on the attachment/detachment state of the process cartridge 10Y, operation stopped states of the lubricant supplying roller 15*a* of the lubricant supplying device 15 and the image forming apparatus 1 are canceled, and then the lubricant supplying roller 15*a* and the image forming apparatus 1 are controlled to continue their operations. Furthermore, when a state that the residual amount of the solid lubricant 15*b* reaches a third predetermined amount is detected by the residual amount detector, "an absolute end state" that the residual amount of the solid lubricant 15*b* is nothing, as shown in FIG. 3D, is informed by outputting a control signal. The third predetermined amount is a smaller amount than the second predetermined amount in terms of the residual amount of the solid lubricant 15*b*. Then, the request of the maintenance is informed by outputting a control signal. Then, the lubricant supplying roller 15*a* of the lubricant supplying device 15 and an operation of the image forming apparatus 1 are controlled to maintain the operation stopped states thereof, until the maintenance is completed.

In detail, the lubricant supplying device 15 in this embodiment includes the supporter 15*d* that supports the solid lubricant 15*b*, which is formed of a conductive material (e.g., a metal), and which displaces toward the lubricant supplying roller 15*a* with consumption of the solid lubricant 15*b*. The lubricant supplying device 15 includes the plate springs 45. Further, when the residual amount of the solid lubricant 15*b* reaches the first predetermined amount, the supporter 15*d* displaces to the state shown in FIG. 3B from the state shown in FIG. 3A. Then, the supporter 15*d* makes contact with the plate springs 45 serving as the conductive member. In this embodiment, both of the supporter 15*d* and the plate springs 45 are formed of a metal material that is for example a copper, a stainless steel, an iron, and so on.

Further, referring to FIG. 2, the plate springs 45 are connected to a detector 46 (conduction detector). The plate springs 45 are in a state that makes contact with the solid lubricant 15*b* made of a non-conductive material (shown in FIG. 3A). Subsequently, the plate springs 45, made of a conductive material, are in a state that makes first contact with the supporter 15*d* made of a conductive material (shown in FIG. 3B). The residual amount of the solid lubricant 15*b* gradually becomes smaller, and then, the plate springs 45 makes first contact with the supporter 15*d*. The detector 46 is configured to detect the change of the states that change a non-conduction state into a conduction state. As this detector 46, a measuring instrument or a detecting instrument that develops the measuring instrument can be used.

The residual amount detector is configured to detect the state that the residual amount of the solid lubricant 15*b* reaches the first predetermined amount (shown in FIG. 3B) by detecting the change of the states that change the non-conduction state into the conduction state. Subsequently, an operation period (or a running distance) of the lubricant supplying roller 15*a* (or the photoconductor 11) is counted by a counter (or a timer). When a count value counted by the counter reaches a first reference value, the residual amount detector is configured to detect the state that the residual amount of the solid lubricant 15*b* reaches the second predetermined amount (shown in FIG. 3C "end state"). Further, when a count value counted by the counter reaches a second reference value, the residual amount detector is configured to detect the state that the residual amount of the solid lubricant 15*b* reaches the third predetermined amount (shown in FIG. 3D "absolute end state").

Namely, in this embodiment, the plate springs 45, the supporter 15*d*, and detector 46 function as the residual amount detector from a regular state that the residual amount of the solid lubricant 15*b* is enough, as shown in FIG. 3A, to the near-end state shown in FIG. 3B. Further, the counter 49 and the controller 60 function as the residual amount detector from the end state shown in FIG. 3C to the absolute end state shown in FIG. 3D. In other words, the residual amount detector uses a mechanical detection method to detect the near-end state, and uses a software detection method to detect the end state and the absolute end state.

In this way, by this configuration that uses two methods, which are the mechanical detection method and the software detection method, compared with a case that uses the mechanical detection method to detect the near-end state, the end state, and the absolute end state, it does not need to add a mechanical detecting member. Consequently, the configuration of the lubricant supplying device 15 becomes simpler, more compact size, and more low cost. In a case that can ignore the size and the cost of the lubricant supplying device 15, it is possible to use the mechanical detection method not only for the near-end state but also for the end state and the absolute end state.

Further, in this embodiment, as shown in FIGS. 3B, 3C, and 3D, the plate springs 45 are configured to make contact with the supporter 15*d*, and to absolutely maintain the conduction state by the urging force of the plate springs 45 until the solid lubricant 15*b* reaches the absolute end state via the near-end state and the end state. By this configuration, when the replacement maintenance of the solid lubricant 15*b* is completed, even if a set new one of the solid lubricant 15*b* is a small residual amount, it is possible to detect the state in FIGS. 3B, 3C, and 3D by the detector 46.

In this embodiment, the first predetermined amount corresponding to the near-end state is regulated so that the solid lubricant 15*b* at this state is about 10% of an initial use amount. Further, the second predetermined amount corresponding to the end state is regulated so that the solid lubricant 15*b* at this state is about 3% of an initial use amount. Furthermore, the third predetermined amount corresponding to the absolute end state is regulated so that the solid lubricant 15*b* at this state is about 0% of an initial use amount.

Figure 4:
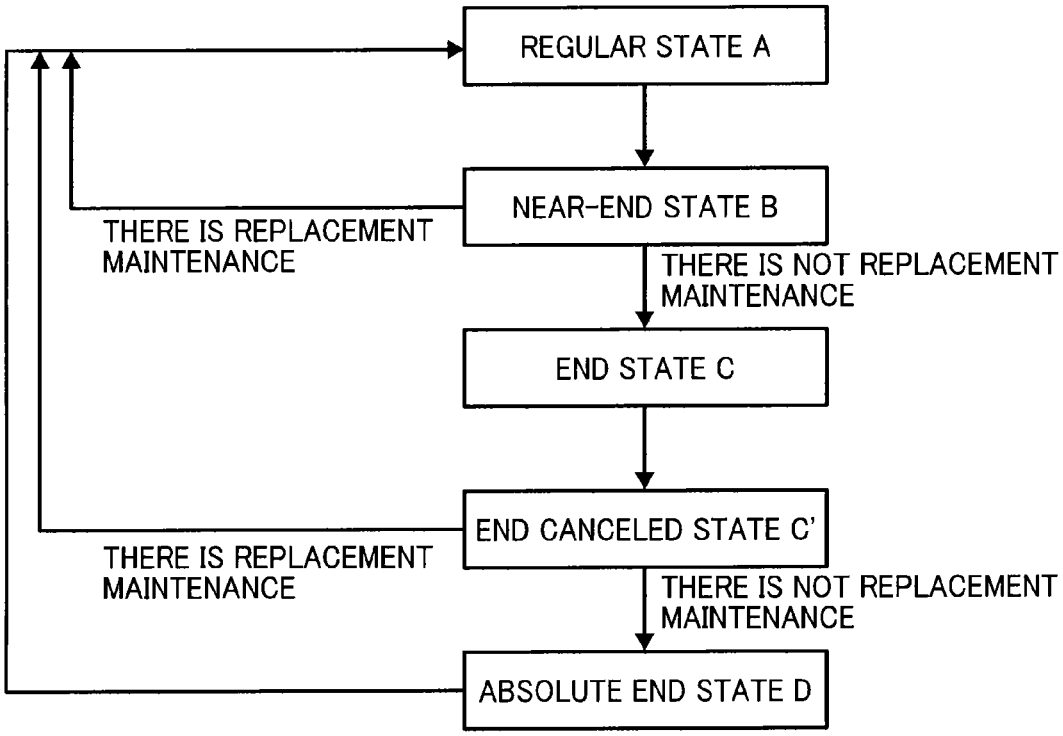
FIG. 4 is a schematic diagram illustrating a process of detecting the residual amount of the solid lubricant.

When the near-end state is detected, a display, which is disposed at an exterior portion of the image forming apparatus, is controlled by the controller 60 so as to display a text such as "Solid lubricant will be consumed soon. Please prepare a replacement." Alternatively, a simple figure providing a similar indication may be displayed. These displays are herein after called "near-end display." As a process shown in FIG. 4, when the replacement maintenance is completed in this near-end state, the residual amount returns to the regular state. Then, the regular state is detected by the detector 46, and the near-end display is turned to a non-display.

On the other hand, in a case that the replacement maintenance is not completed in the near-end state, the end state is detected when the count value reaches the first reference value. When the end state is detected, the display is controlled by the controller 60 so as to display a text such as "Solid lubricant was consumed. Please operate a replacement. However, dozens of prints are possible before the replacement." Alternatively, a simple figure providing a similar indication may be displayed. These displays are displayed instead of the near-end display or with the near-end display. This display in the end state is hereinafter called "end display." Further, when the end display is displayed, the operation of the image forming apparatus 1 is stopped at the same time so as not to perform the image forming operation temporarily. After that, as a process shown in FIG. 4, this end state is canceled by attachment/detachment of the process cartridge 10Y, and then, the process shifts to "an end canceled state" that dozens of image forming operations are possible. Further, instead of the attachment/detachment of the process cartridge 10Y, the end state can be canceled by an operation of a key displayed on the display 50 or an input operation of a cancel confirmation information.

In the end canceled state, instead of the end display, a near absolute end display is displayed on the display 50 such as "Solid lubricant was consumed. Please operate a replacement as soon as possible." Further, when the replacement maintenance is completed in this end canceled state, the residual amount returns to the regular state. Then, the regular state is detected by the detector 46, and the near absolute end display is turned to a non-display.

On the other hand, in a case that the replacement maintenance is not completed in the end canceled state, the absolute end state is detected when the count value reaches the second reference value. When the absolute end state is detected, the display is controlled by the controller 60 so as to display a text such as "Solid lubricant was consumed. Please operate a replacement. The image forming operation is suspended until the replacement is completed." Alternatively, a simple figure providing a similar indication may be displayed. These displays are hereinafter called "absolute end display." Further, when the absolute end display is displayed, the operation of the image forming apparatus 1 is suspended at the same time so as not to perform the image forming operation. Further, when the replacement maintenance is completed in this state, the residual amount returns to the regular state. Then, the regular state is detected by the detector 46, and the absolute end display is turned to a non-display.

Because of a replacement cycle of the solid lubricant 15*b* is longer than the toner containers, users often have not prepared the solid lubricant 15*b* for replacement when the machine is stopped by detecting the end state of the solid lubricant 15*b*.

Therefore, in this embodiment, even if the end state of the solid lubricant 15*b* is detected, instead of suspending the image forming operation suddenly, the controller 60 is configured to operate some of the image forming operations with using the solid lubricant 15*b* that is a small residual amount. By this configuration, even if preparing the replacement in the near-end state is forgotten, it is possible to prepare the replacement during the some of the image forming operations. Therefore, when the replacement maintenance of the solid lubricant 15*b* is completed, a down time of the image forming operation is reduced.

Referring FIGS. 5 to 9, the control that repeats detecting the residual amount of the solid lubricant 15*b* at a predetermined timing is explained below.

Figure 5:
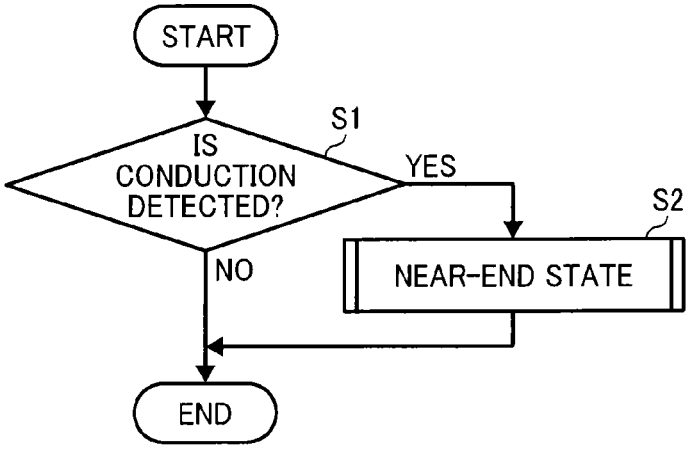
FIG. 5 is a flowchart illustrating steps in the process of detecting the residual amount of the solid lubricant.

First, as illustrated in FIG. 5, whether the conduction between the plate springs 45 and the supporter 15*d* exists or not is detected by the detector 46, and then, a detection result is determined (STEP S1). Consequently, in a case that the non-conduction is determined from the detection result, the controller 60 determines that the solid lubricant 15*b* is in the regular state shown in FIG. 3A, which is a state that the residual amount of the solid lubricant 15*b* is enough, and the controller 60 terminates this control flow. On the other hand, in a case that the conduction is determined from the detection result, the controller 60 determines that the solid lubricant 15*b* is in the near-end state shown in FIG. 3B, which is a state that the residual amount of the solid lubricant 15*b* reaches the first predetermined amount, and the controller 60 shifts the control flow to a control flow shown in FIG. 6 (STEP S2).

Figure 6:
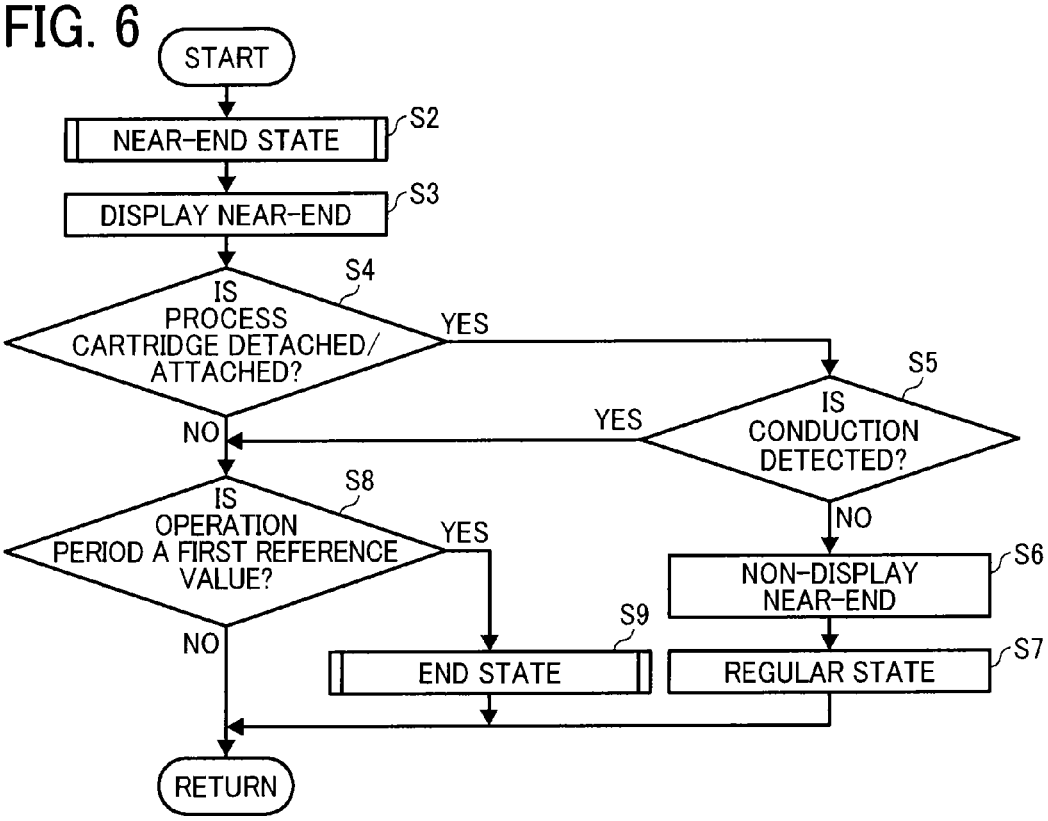
FIG. 6 is a flowchart illustrating steps following the steps in FIG. 5.

When the near-end state is detected in the control flow in FIG. 5, as shown in FIG. 6, first, the near-end display is displayed on the display 50 of the image forming apparatus 1 (STEP S3). Further, instead of being disposed at the image forming apparatus, the display 50 can use a monitor screen, where is at a remote location, via a communicating network.

After that, whether the attachment/detachment operation, which is a replacement of the process cartridge 10Y in the near-end state with the new one, is completed or not is determined by a detection result of the set detecting sensor mentioned above (STEP S4). Consequently, in a case that the attachment/detachment operation of the process cartridge 10Y is completed is determined from the detection result, whether or not the conduction state is detected by the detector 46 is determined (STEP S5). Consequently, in a case that it is determined that the conduction state is not detected, it is determined that the replacement maintenance of the solid lubricant 15*b* is properly completed. Then, the near-end state is canceled and the near-end display is turned to the non-display (STEP S6). After that, the controller 60 determines that the solid lubricant 15*b* is in the regular state (STEP S7), the controller 60 shifts (returns) the control flow to the control flow shown in FIG. 5 that is in the near-end state (STEP S2) and the controller 60 terminates this control flow. Namely, in this case, the solid lubricant 15*b* is in the regular state when the controller 60 terminates the control flow of FIG. 5.

On the other hand, in a case that the attachment/detachment operation of the process cartridge 10Y is not completed is determined at the STEP S4, it is determined that the replacement maintenance of the solid lubricant 15*b* is not properly completed. Further, in a case that it is determined that the conduction state is detected at the STEP S5, it is also determined that the replacement maintenance of the solid lubricant 15*b* is not properly completed. Then, whether the operation period from an initial use time of the solid lubricant 15*b* to the near-end detected reaches a first reference value is determined, to determine whether or not the residual amount of the solid lubricant 15*b* reaches the second predetermined amount (STEP S8). Consequently, in a case it is determined that the operation period from an initial use time of the solid lubricant 15*b* to the near-end detected does not reach the first reference value, the controller 60 determines that the solid lubricant 15*b* is not in the end state (maintains the near-end state). Then, the controller 60 terminates this control flow. After that, the controller 60 shifts (returns) the control flow to the control flow shown in FIG. 5 that is in the near-end state (STEP S2). Hereafter, when the detection repeats, whether the solid lubricant 15*b* changes from the near-end state to another state in the control flow is determined in later steps in FIG. 6.

Figure 7:
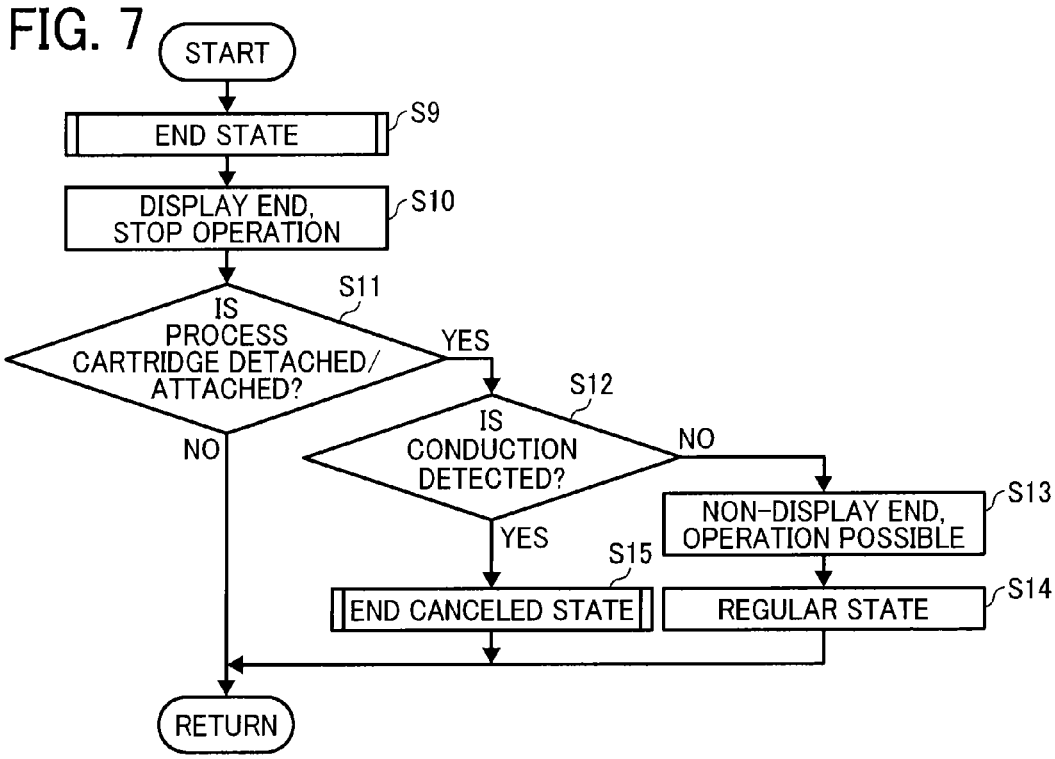
FIG. 7 is a flowchart illustrating steps following the steps in FIG. 6.

On the other hand, in a case that it is determined that the operation period from an initial use time of the solid lubricant 15*b* to the near-end detected reaches the first reference value, the controller 60 determines that the solid lubricant 15*b* is in the end state and shifts the control flow to a control flow shown in FIG. 7 (STEP S9).

When the end state (STEP S9) is detected in the control flow in FIG. 6, as shown in FIG. 7, first, the end display is displayed. Then, operation of the image forming apparatus, especially that of the photoconductor 11 of the process cartridge 11Y and the lubricant supplying roller 15*a* of the lubricant supplying device 15, is stopped (STEP S10). After that, whether the attachment/detachment operation, that is a replacement of the process cartridge 10Y in the end state with the new one, is completed or not is determined by a detection result of the set detecting sensor mentioned above (STEP S11). Consequently, in a case that it is determined from the detection result that the attachment/detachment operation of the process cartridge 10Y is not completed, the controller 60 terminates the control flow shown in FIG. 7. After that, the controller 60 shifts (returns) the control flow to the control flow shown in FIG. 6 that is in the end state (STEP S9). After that, the controller 60 shifts (returns) the control flow to the control flow shown in FIG. 5 that is in the near-end state (STEP S2), and the controller 60 terminates this control flow. Namely, in this case, the solid lubricant 15*b* is in the end state when the controller 60 terminates the control flow of FIG. 5.

On the other hand, in a case that it is determined from the detection result that the attachment/detachment operation of the process cartridge 10Y is completed, whether or not the conduction state is detected by the detector 46 is determined (STEP S12). Consequently, in a case that it is determined that the conduction state is not detected, it is determined that the replacement maintenance of the solid lubricant 15*b* is properly completed. Then, the end state is canceled and the end display is turned to the non-display. Then, the stopped operation state of the image forming apparatus is canceled (STEP S13), and the controller 60 determines that the solid lubricant 15*b* is in the regular state (STEP S14). The controller 60 shifts (returns) the control flow to the control flow shown in FIG. 6 that is in the end state (STEP S9). After that, the controller 60 shifts (returns) the control flow to the control flow shown in FIG. 5 that is in the near-end state (STEP S2), and the controller 60 terminates this control flow. Namely, in this case, the solid lubricant 15*b* is in the regular state when the controller 60 terminates the control flow of FIG. 5.

On the other hand, in a case that it is determined that the conduction state is detected by the detector 46 at the STEP S12, it is determined that the replacement maintenance of the solid lubricant 15*b* is not properly completed. Then, the controller 60 shifts the control flow to the control flow shown in FIG. 8 to shift to the end canceled state (STEP S15).

Figure 8:
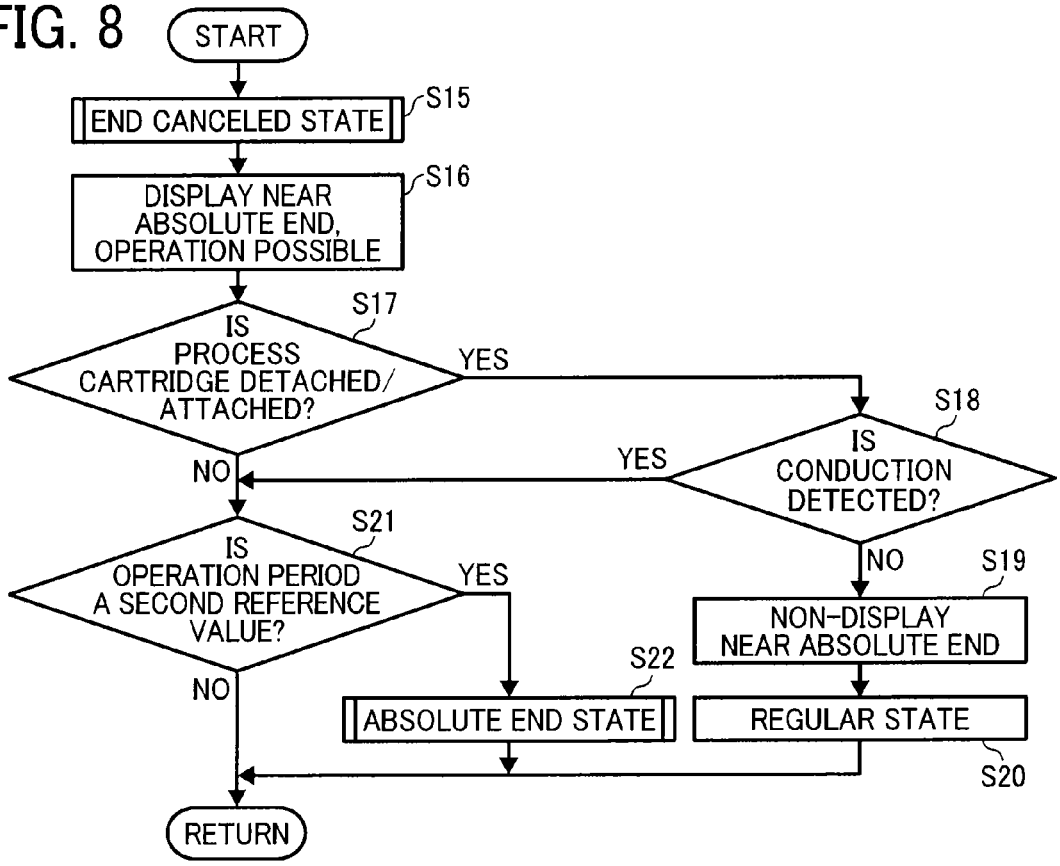
FIG. 8 is a flowchart illustrating steps following the steps in FIG. 7.

When the control flow is shifted to the end canceled state (STEP S15) in FIG. 7, as shown in FIG. 8, first, the near absolute end display is displayed. Then, it is possible to operate the image forming apparatus that is stopped temporarily to the operation (STEP S16). After that, it is determined whether or not the attachment/detachment operation of the process cartridge 10Y in the end canceled state is completed (STEP S17). Consequently, in a case that it is determined from the detection result that the attachment/detachment operation of the process cartridge 10Y is completed, it is determined whether or not the conduction state is detected by the detector 46 (STEP S18). Consequently, in a case that it is determined that the conduction state is not detected, it is determined that the replacement maintenance of the solid lubricant 15*b* is properly completed. Then, the near-end canceled state is canceled and the near absolute end display is turned to the non-display (STEP S19). After that, the controller 60 determines that the solid lubricant 15*b* is in the regular state (STEP S20), and the controller 60 shifts (returns) the control flow to the control flow shown in FIG. 7 that is in the end canceled state (STEP S15). After that, the controller 60 shifts (returns) the control flow to the control flow shown in FIG. 6 that is in the end state (STEP S9). Further after that, the controller 60 shifts (returns) the control flow to the control flow shown in FIG. 5 that is in the near-end state (STEP S2), and the controller 60 terminates this control flow. Namely, in this case, the solid lubricant 15*b* is in the regular state when the controller 60 terminates the control flow of FIG. 5.

On the other hand, in a case that it is determined that the attachment/detachment operation of the process cartridge 10Y is not completed at the STEP S17, it is determined that the replacement maintenance of the solid lubricant 15*b* is not properly completed. Further, in a case that it is determined that the conduction state is detected by the detector 46 at the STEP S18, it is also determined that the replacement maintenance of the solid lubricant 15*b* is not properly completed. Then, whether the operation period from an initial use time of the solid lubricant 15*b* to a shift to the end canceled state reaches the second reference value is determined, to determine whether or not the residual amount of the solid lubricant 15*b* reaches the third predetermined amount (STEP S21). Consequently, in a case it is determined that the operation period from an initial use time of the solid lubricant 15*b* to the shift to the end canceled state does not reach the second reference value, the controller 60 determines that the solid lubricant 15*b* is not in the absolute end state. Then, the controller 60 shifts (returns) the control flow to the control flow shown in FIG. 7 that is in the end canceled state (STEP S15). After that, the controller 60 shifts (returns) the control flow to the control flow shown in FIG. 6 that is in the end state (STEP S9). Further after that, the controller 60 shifts (returns) the control flow to the control flow shown in FIG. 5 that is in the near-end state (STEP S2), and the controller 60 terminates this control flow. Namely, in this case, the solid lubricant 15*b* is in the end canceled state when the controller 60 terminates the control flow of FIG. 5.

Figure 9:
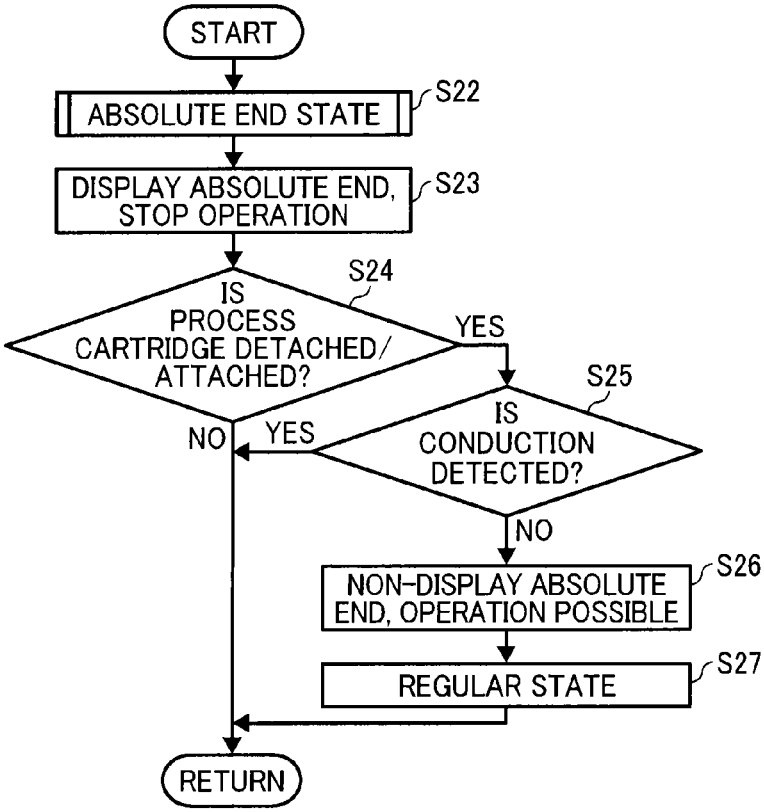
FIG. 9 is a flowchart illustrating steps following the steps in FIG. 8.

On the other hand, in a case it is determined that the operation period from an initial use time of the solid lubricant 15*b* to the shift to the end canceled state reaches the second reference value, the controller 60 determines that the solid lubricant 15*b* is in the absolute end state and shifts the control flow to a control flow shown in FIG. 9 (STEP S22).

When the absolute end state is detected in the control flow in FIG. 8, as shown in FIG. 9, first, the absolute end display is displayed. Then, operation of the image forming apparatus is stopped (STEP S23). After that, it is determined whether or not the attachment/detachment operation of the process cartridge 10Y in the absolute end state is completed (STEP S24). Consequently, in a case that it is determined from the detection result that the attachment/detachment operation of the process cartridge 10Y is not completed, the controller 60 terminates this control flow. After that, the controller 60 shifts (returns) the control flow to the control flow shown in FIG. 8 that is in the absolute end state (STEP S22). Then, the controller 60 shifts (returns) the control flow to the control flow shown in FIG. 7 that is in the end canceled state (STEP S15). After that, the controller 60 shifts (returns) the control flow to the control flow shown in FIG. 6 that is in the end state (STEP S9). Further after that, the controller 60 shifts (returns) the control flow to the control flow shown in FIG. 5 that is in the near-end state (STEP S2), and the controller 60 terminates this control flow. Namely, in this case, the solid lubricant 15*b* is in the absolute end state when the controller 60 terminates the control flow of FIG. 5.

On the other hand, in a case that it is determined from the detection result that the attachment/detachment operation of the process cartridge 10Y is completed, it is determined whether or not the conduction state is detected by the detector 46 (STEP S25). Consequently, in a case that it is determined that the conduction state is not detected by the detector 46, it is determined that the replacement maintenance of the solid lubricant 15*b* is properly completed. Then, the absolute end display is turned to the non-display. Then, the stopped operation state of the image forming apparatus is canceled (STEP S26), and the controller 60 determines that the solid lubricant 15*b* is in the regular state and terminates this control flow (STEP S27). After that, the controller 60 shifts (returns) the control flow to the control flow shown in FIG. 8 that is in the absolute end state (STEP S22). Then, the controller 60 shifts (returns) the control flow to the control flow shown in FIG. 7 that is in the end canceled state (STEP S15). After that, the controller 60 shifts (returns) the control flow to the control flow shown in FIG. 6 that is in the end state (STEP S9). Further after that, the controller 60 shifts (returns) the control flow to the control flow shown in FIG. 5 that is in the near-end state (STEP S2), and the controller 60 terminates this control flow. Namely, in this case, the solid lubricant 15*b* is in the regular state when the controller 60 terminates the control flow of FIG. 5.

On the other hand, in a case that it is determined that the conduction state is detected by the detector 46 at the STEP S25, it is determined that the replacement maintenance of the solid lubricant 15*b* is not properly completed. Then, the controller 60 terminates this control flow. After that, the controller 60 shifts (returns) the control flow to the control flow shown in FIG. 8 that is in the absolute end state (STEP S22). Then, the controller 60 shifts (returns) the control flow to the control flow shown in FIG. 7 that is in the end canceled state (STEP S15). After that, the controller 60 shifts (returns) the control flow to the control flow shown in FIG. 6 that is in the end state (STEP S9). Further after that, the controller 60 shifts (returns) the control flow to the control flow shown in FIG. 5 that is in the near-end state (STEP S2), and the controller 60 terminates this control flow. Namely, in this case, the solid lubricant 15*b* is in the absolute end state when the controller 60 terminates the control flow of FIG. 5.

In this embodiment, it is possible that the controller 60 is configured to correct the first reference value and the second reference value (explained in FIG. 6 and in FIG. 8) based on the count value that is detected by the counter 49. The count value corresponds to the operation period (or a running distance) of the lubricant supplying roller 15*a* (or the photoconductor 11) between an initial use time of the solid lubricant 15*b* and a timing of a state when the residual amount of the solid lubricant 15*b* is detected as reaching the first predetermined amount.

Specifically, when the operation period is larger than a predetermined assumption, a consumption of the solid lubricant 15*b* is estimated to be smaller than usual. Then, the first reference value and the second reference value are multiplied by a coefficient $\alpha$ that is larger than 1. Consequently, the first reference value and the second reference value are corrected to be larger. On the other hand, when the operation period is smaller than the predetermined assumption, the consumption of the solid lubricant 15*b* is estimated to be larger than usual. Then, the first reference value and the second reference value are multiplied by a coefficient $\beta$ that is smaller than 1. Consequently, the first reference value and the second reference value are corrected to be smaller.

This control is especially beneficial in the case that the consumption of the solid lubricant 15*b* makes a large change depending on a use environment (temperature and humidity) of the solid lubricant 15*b*, and depending on an image tendency of a user (for example, tendency of image area ratio in an output image). Namely, even if the consumption of the solid lubricant 15*b* makes a large change depending on the use environment, it is possible to accurately detect the end state and the absolute end state by the residual amount detector including the counter 49.

Further, in this embodiment, the residual amount detector is configured to output a signal which informs that the residual amount of the solid lubricant 15*b* reaches the first predetermined amount, by detecting the change from the non-conduction state into the conduction state, when the supporter 15*d* makes contact with the plate springs 45.

Figure 10:
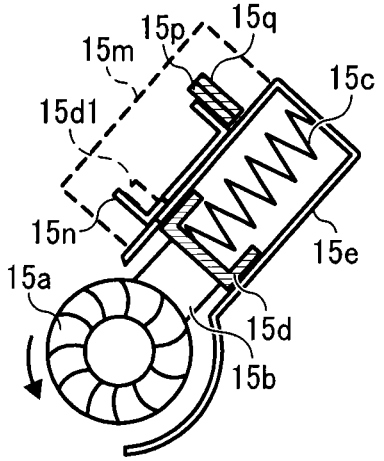
FIG. 10 is a schematic view illustrating an example of a configuration of a lubricant supplying device, in a near-end stage of a solid lubricant, according to another variation of the illustrative embodiment.
Figure 11:
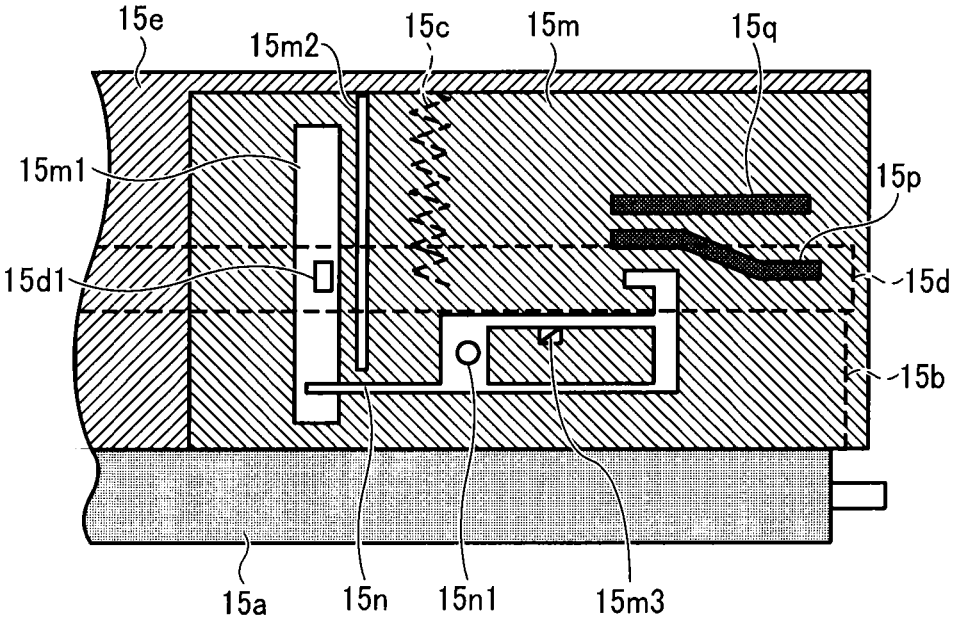
FIG. 11 is a schematic diagram illustrating a configuration of detecting the residual amount of the solid lubricant employed in the lubricant supplying device according to FIG. 10.

On the other hand, referring to FIG. 10 and FIG. 11, the residual amount detector includes a supporter 15*d* made of conductive material or non-conductive material and an engaging member 15*n* which makes contact with the supporter 15*d* when the residual amount of the solid lubricant 15*b* reaches the first predetermined amount. The residual amount detector is configured to output a signal which informs that the residual amount of the solid lubricant 15*b* reaches the first predetermined amount, by detecting the contact between the supporter 15*d* and the engaging member 15*n*.

FIG. 10 is a schematic view illustrating an example of a configuration of a lubricant supplying device according to another variation of the illustrative embodiment, and FIG. 11 is a schematic diagram illustrating a configuration of detecting the residual amount of the solid lubricant employed in the lubricant supplying device according to FIG. 10. The guide 15*e* made of non-conductive resin material includes a first electrode 15*p*, a second electrode 15*q*, and the engaging member 15*n* (rotating member) at an outer face thereof. The first electrode 15*p*, the second electrode 15*q*, and the engaging member 15*n* are covered by a detector cover 15*m*.

The detector cover 15*m* and the guide 15*e* include an opening 15*m*1, which is disposed near a partition 15*m*2, and which is extending in the same direction as the direction that the solid lubricant 15*b* is pressed by the lubricant supplying roller 15*a*. Further, a protrusion 15*d*1 disposed at the supporter 15*d* protrudes from the opening 15*m*1 toward an outer side of the guide 15*e*.

The engaging member 15*n* is supported at the outer side of the guide 15*e* around a spindle 15*n*1, and the engaging member 15*n* can rotate in a counterclockwise direction (or a clockwise direction) in FIG. 11. The engaging member 15*n* is configured to be limited to rotate in the clockwise direction by making contact with a boss 15*m*3 disposed at the detector cover 15*m*. One end side (at a right side shown in FIG. 11) of the engaging member 15*n* can make contact with one end side of the first electrode 15*p*. Further, the other side (at a left side shown in FIG. 11) of the engaging member 15*n* can make contact with the protrusion 15*d*1 of the supporter 15*d*.

The first electrode 15*p* is a plate shaped member having an elastic character, and one end side (at a right side shown in FIG. 11) of first electrode 15*p* is a secured end, and the other end side (at a left side shown in FIG. 11) of first electrode 15*p* is a free end. The second electrode 15*q* is secured one end side throughout the other end side thereof. The free end of the first electrode 15*p* can make contact with the second electrode 15*q*. Further, the first electrode 15*p* and the second electrode 15*q* are connected to an electric circuit that is configured to electrically detect a contact state of two electrodes and a non-contact state. The contact state corresponds to the near-end state in FIG. 10. The non-contact state corresponds to the regular state, that the residual amount of the solid lubricant 15*b* is enough, in FIG. 11.

By the configuration mentioned above, as illustrated in FIG. 11, when the residual amount of the solid lubricant 15*b* is enough, the engaging member 15*n* does not make contact with the protrusion 15*d*1 of the supporter 15*d*. Then, a state that the first electrode 15*p* and the second electrode 15*q* are separated from each other is detected by the electric circuit.

In this configuration, the engaging member 15*n*, the protrusion 15*d*1 (engaged member), the first electrode 15*p*, the second electrode 15*q*, and the electric circuit are serving as the residual amount detector. Further, by this configuration, it is possible to operate the same control as the control in the embodiment mentioned earlier, and to earn the same advantage (good effectiveness) as the advantage of the embodiment mentioned earlier.

In this embodiment, the lubricant supplying device 15 includes the compression spring 15*c* serving as an urging member that urges the solid lubricant 15*b* toward the lubricant supplying roller 15*a*, but the urging member is not limited to the compression spring 15*c*.

Figure 12:
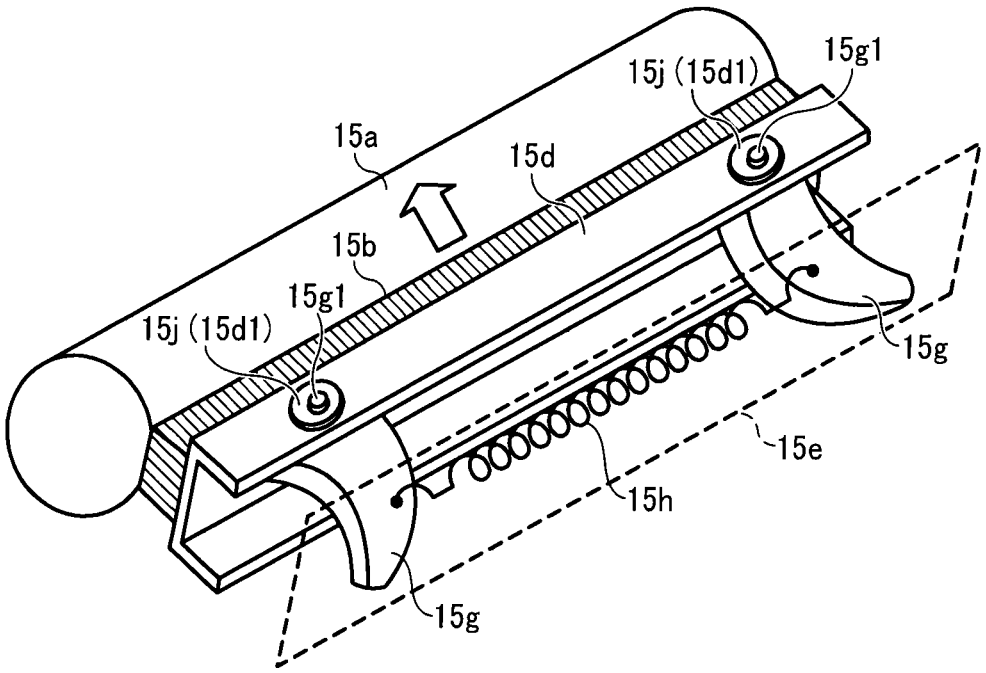
FIG. 12 is a perspective view illustrating an example of a configuration of a lubricant supplying device according to another variation of the illustrative embodiment.

FIG. 12 is a perspective view illustrating an example of a configuration of a lubricant supplying device according to another variation of the illustrative embodiment. Referring to FIG. 12, a pressing mechanism 15*d*, 15*g*, 15*h*, 15*j* is disposed at a rear side of the solid lubricant 15*b*. The pressing mechanism includes the supporter 15*d*, a pair of rotating members 15*g*, a tension spring 15*h*, and a bearing 15*j*. The pair of rotating members 15*g* is rotatably supported to the supporter 15*d*, and the tension spring 15*h* is connected to the pair of rotating members 15*g*. The rear side of the solid lubricant 15*b* is an opposite side to contacts the lubricant supplying roller 15*a*. The pressing mechanism 15*d*, 15*g*, 15*h*, 15*j* is configured to reduce a contact unevenness between the lubricant supplying roller 15*a* and the solid lubricant 15*b*. The pressing mechanism 15*d*, 15*g*, 15*h*, 15*j* is serving as the urging member that urges the solid lubricant 15*b*, which is attached to the supporter 15*d*, toward the lubricant supplying roller 15*a*.

The supporter 15*d*, which holds the solid lubricant 15*b*, includes a metal plate that is formed in a channel shape. The channel shape is formed by bending at a first point of the metal plate in a first direction, subsequently, bending at a second point, which is different from the first point, of the metal plate in the same direction as the first direction. The supporter 15*d* includes a plurality of holes 15*d*1 at the both sides thereof. The plurality of holes 15*d*1 support the pair of rotating members 15*g* via the bearing 15*j*. Each of the pair of rotating members 15*g* is disposed at a distance in a longitudinal direction of the supporter 15*d*, and is rotatably supported to the supporter 15*d*. The longitudinal direction of the supporter 15*d* is corresponding to a direction perpendicular to a paper surface direction of FIG. 2. The pair of rotating members 15*g* indirectly push the solid lubricant 15*b* via the supporter 15*d* by being rotated with an urging force of the tension spring 15*h* in a predetermined direction each other. Then, the solid lubricant 15*b* is made a pressed contact with the lubricant supplying roller 15*a*.

In more detail, each of the pair of rotating members 15*g* includes a spindle 15*g*1 (support shaft), serving as a rotational center, at the both sides thereof. The spindle 15*g*1 is inserted into the bearing 15*j*, in this state, the bearing 15*j* is fitted in each of the plurality of holes 15*d*1 of the supporter 15*d*. Then, each of the pair of rotating members 15*g* is rotatably supported to the supporter 15*d*. Further, the pair of rotating members 15*g* is symmetrically disposed relative to each other in the longitudinal direction of the supporter 15*d*.

Further, the pair of rotating members 15*g* is connected by the tension spring 15*h*. In detail, two hooks at both ends of the tension spring 15*h* are each connected to a hole, which is disposed at each of the pair of rotating members 15*g*.

Further, the tension spring 15*h* urges the supporter 15*d* toward the lubricant supplying roller 15*a* by pressing the guide 15*e* which is pressed by the pair of rotating members 15*g* that rotate in different direction each other. Specifically, each of the pair of rotating members 15*g* includes a cam-shaped portion that contacts at an inner surface of the guide 15*e*. The cam-shaped portions of the pair of rotating members 15*g* receive the urging force of the tension spring 15*h*, the urging force acts in such direction that the cam-shaped portions approach each other. Consequently, referring to FIG. 12, one of the pair of rotating members 15*g* at the left side in FIG. 12 is urged to be rotate about the spindle 15*g*1 as a rotational center in the counterclockwise direction, and the other of the pair of rotating members 15*g* at the right side in FIG. 12 is urged to be rotate about the spindle 15*g*1 as a rotational center in the clockwise direction.

Further, by this configuration, it is possible to operate the same control as the control in the embodiment mentioned earlier, and to earn the same benefit (good effectiveness) as the benefit in the embodiment mentioned earlier.

As described above, in this embodiment, when the state that the residual amount of the solid lubricant 15*b* reaches the first predetermined amount is detected by the residual amount detector, the near-end state is informed by outputting the control signal. Further, when the state that the residual amount of the solid lubricant 15*b* reaches the second predetermined amount is detected by the residual amount detector, operation of the lubricant supplying roller 15*a* is stopped. The second predetermined amount is smaller amount than the first predetermined amount and is used to inform the end state. After that, even if the maintenance is not completed, the operation stopped state of the lubricant supplying roller 15*a* is canceled by a predetermined operation. Furthermore, when the state that the residual amount of the solid lubricant 15*b* reaches the third predetermined amount is detected by the residual amount detector, operation of the lubricant supplying roller 15*a* is stopped. The third predetermined amount is smaller amount than the second predetermined amount and is used to inform the absolute end state. After that, the lubricant supplying roller 15*a* is controlled to maintain the operation stopped state thereof, until the replacement of the solid lubricant 15*b* is completed.

The lubricant supplying device 15 supplies the solid lubricant 15*b* on the photoconductor 11 supporting the toner image. The lubricant supplying device 15 includes the lubricant supplying roller 15*a* that makes a sliding contact with the photoconductor 11 by rotating in a predetermined direction, the solid lubricant 15*b* that makes a sliding contact with the lubricant supplying roller 15*a*, the residual amount detector that detects the residual amount of the solid lubricant 15*b*, and the controller 60 that is configured to control the supplying operation of the lubricant supplying roller 15*a* based on a detection result detected by the residual amount detector.

The residual amount detector is configured to output a first signal that informs the solid lubricant 15*b* is in the near-end state to the controller 60 when the residual amount of the solid lubricant reaches the first predetermined amount. Further, the residual amount detector is configured to output a second signal that informs the solid lubricant 15*b* is in the end state to the controller 60 when the residual amount of the solid lubricant 15*b* reaches the second predetermined amount that is smaller than the first predetermined amount. Further, the residual amount detector is configured to output a third signal that informs the solid lubricant 15*b* is in the absolute end state to the controller 60 when the residual amount of the solid lubricant 15*b* reaches the third predetermined amount that is smaller than the second predetermined amount.

The controller 60 is configured to temporarily stop the supplying operation of the lubricant supplying roller 15*a* when the residual amount detector outputs the second signal, and to cancel a temporary stopped state of the lubricant supplying roller 15*a* by a predetermined operation. Further, even if the replacement of the solid lubricant 15*b* is not completed after the temporary stopped state, the controller 60 is configured to stop the supplying operation of the lubricant supplying roller 15*a* when the residual amount detector outputs the third signal, and to maintain the stopped state until the replacement of the solid lubricant 15*b* is completed after the stopped state.

In this way, even if the end state of the solid lubricant 15*b* is detected, the down time for the maintenance of the solid lubricant 15*b* and the image forming apparatus is reduced in the image forming operation.

Further, in this embodiment, the process cartridge 10Y integrally includes the photoconductor 11, the charger 12, the developing device 13, the cleaning device 14, and the lubricant supplying device 15. By this configuration of the process cartridge 10Y, the image forming part of the image forming apparatus 1 becomes more compact. Then, it is possible to improve the usability of the maintenance. However, the photoconductor 11, the charger 12, the developing device 13, the cleaning device 14, and the lubricant supplying device 15 can independently be mounted on the image forming apparatus 1.

Further, in this embodiment, the present invention is implemented in the image forming apparatus which is equipped with the developing device 13 that uses the two-component type developer in a two-component developing method. However, it is also possible to be implemented in the image forming apparatus which is equipped with a developing device 13 that uses a one-component type developer in a one-component developing method.

Further, in this embodiment, the present invention is implemented in the image forming apparatus which is equipped with the lubricant supplying device 15 that is configured to supply the lubricant to the photoconductor 11 (photoconductor drum) serving as the image bearer. However, it is also possible to be implemented in the image forming apparatus which is equipped with a lubricant supplying device 15 that is configured to supply the lubricant to a photoconductor belt. Furthermore, it is also possible to be implemented in the image forming apparatus which is equipped with a lubricant supplying device 15 that is configured to supply the lubricant to a surface of the intermediate transfer belt 17.

Further, in this embodiment, the lubricant supplying roller 15*a* is a roller constructed of a metal shaft and an elastic foam layer coating the metal shaft. However, the lubricant supplying roller 15*a* can be constructed of a metal shaft and bristles, that are formed straight or roped, wound around the metal shaft. In this case, specific examples of the material used for the bristles of the lubricant supplying roller 15*a* include, but are not limited to, resin fibers such as polyester fibers, nylon fibers, rayon fibers, acrylic fibers, vinylon fibers, vinyl chloride fibers, and so on. Alternatively, conductive fibers in which a conductivity imparting agent such as carbon is mixed may be used for the bristles of the lubricant supplying roller 15*a*, as needed. Further, the lubricant supplying roller 15*a* includes bristles each including a length in a range of 0.2 to 20 [mm], and a density in a range of 20,000 to 100,000 bristles per square inch.

Further, by this configuration, it is possible to earn almost a same advantage (good effectiveness) as the advantage in this embodiment mentioned earlier.

Elements and/or features of different illustrative embodiments may be combined with each other and/or substituted for each other within the scope of this disclosure and appended claims.

The number of constituent elements and their locations, shapes, and so forth are not limited to any of the structures for performing the methodology illustrated in the drawings.

The present invention may be implemented using circuitry and/or one or more processors configured and/or programmed according to the teachings of the present disclosure.

Obviously, numerous modifications and variations of the present invention are possible in light of the above teachings. It is therefore to be understood that within the scope of the appended claims, the invention may be practiced otherwise than as specifically described herein.

What is claimed is:

1. A lubricant supplying device for supplying a lubricant on an image bearer supporting a toner image, comprising:

a lubricant supplier that makes a sliding contact with the image bearer when the image bearer rotates in a predetermined direction;

a solid lubricant that makes a sliding contact with the lubricant supplier;

a residual amount detector that detects a residual amount of the solid lubricant; and a controller that is configured to control a supplying operation of the lubricant supplier based on a detection result detected by the residual amount detector, wherein the residual amount detector outputs a first signal informing that the solid lubricant is in a near-end state to the controller when the residual amount of the solid lubricant reaches a first predetermined amount, and outputs a second signal informing that the solid lubricant is in an end state to the controller when the residual amount of the solid lubricant reaches a second predetermined amount that is smaller than the first predetermined amount, and outputs a third signal informing that the solid lubricant is in an absolute end state to the controller when the residual amount of the solid lubricant reaches a third predetermined amount that is smaller than the second predetermined amount, and wherein the controller is configured to:

temporarily stop the supplying operation of the lubricant supplier when the residual amount detector outputs the second signal, cancel a temporary stopped state of the lubricant supplier by a predetermined operation even when a replacement of the solid lubricant is not completed after the temporary stopped state, stop the supplying operation of the lubricant supplier when the residual amount detector outputs the third signal, and maintain a stopped state of the lubricant supplier until the replacement of the solid lubricant is completed after the stopped state.

2. The lubricant supplying device according to claim 1, further comprising:

a supporter that supports the solid lubricant, and that is displaceable toward the lubricant supplier with consumption of the solid lubricant; and an engaging structure that makes contact with the supporter when the residual amount of the solid lubricant reaches the first predetermined amount, wherein the residual amount detector outputs the first signal when the residual amount detector detects a contact between the supporter and the engaging structure.

3. The lubricant supplying device according to claim 2, wherein the supporter and the engaging structure are formed of a conductive material, and wherein the residual amount detector detects the contact electrically.

4. The lubricant supplying device according to claim 1, further comprising:

a counter to count an operation period of the lubricant supplier, and to output a count value corresponding to the operation period to the controller, wherein the second predetermined amount corresponds to the residual amount when the count value counted by the counter reaches a first reference value, after the operation period of the lubricant supplier when the residual amount of the solid lubricant reaches the first predetermined amount.

5. The lubricant supplying device according to claim 4, wherein the controller is configured to correct the first reference value based on the operation period, and wherein the operation period is between an initial use time of the solid lubricant and a timing of a state when the residual amount of the solid lubricant is detected as reaching the first predetermined amount.

6. The lubricant supplying device according to claim 5, wherein the controller is configured to increase the first reference value when the operation period is larger than a predetermined value.

7. The lubricant supplying device according to claim 5, wherein the controller is configured to decrease the first reference value when the operation period is smaller than a predetermined value.

8. The lubricant supplying device according to claim 1, further comprising:

a counter to count an operation period of the lubricant supplier, and to output a count value corresponding to the operation period to the controller, wherein the third predetermined amount corresponds to the residual amount when the count value counted by the counter reaches a second reference value, after the operation period of the lubricant supplier when the residual amount of the solid lubricant reaches the second predetermined amount.

9. The lubricant supplying device according to claim 4, wherein the third predetermined amount corresponds to the residual amount when the count value counted by the counter reaches a second reference value, after the operation period of the lubricant supplier when the residual amount of the solid lubricant reaches the second predetermined amount.

10. The lubricant supplying device according to claim 8, wherein the controller is configured to correct the second reference value based on the operation period, and wherein the operation period is between an initial use time of the solid lubricant and a timing of a state when the residual amount of the solid lubricant is detected as reaching the first predetermined amount.

11. The lubricant supplying device according to claim 10, wherein the controller is configured to increase the second reference value when the operation period is larger than a predetermined value.

12. The lubricant supplying device according to claim 10, wherein the controller is configured to decrease the second reference value when the operation period is smaller than a predetermined value.

13. A process cartridge used with an image forming apparatus, comprising:

an image bearer that supports a toner image thereon; and a lubricant supplying device that supplies a lubricant on the image bearer;

wherein the lubricant supplying device is the lubricant supplying device according to claim 1.

14. An image forming apparatus, comprising:

an image bearer that supports a toner image thereon; and a lubricant supplying device that supplies a lubricant on the image bearer;

the lubricant supplying device including, a lubricant supplier that makes a sliding contact with the image bearer when the image bearer rotates in a predetermined direction;

a solid lubricant that makes a sliding contact with the lubricant supplier;

a residual amount detector that detects a residual amount of the solid lubricant; and a controller that is configured to control a supplying operation of the lubricant supplier based on a detection result detected by the residual amount detector, wherein the residual amount detector outputs a first signal informing that the solid lubricant is in a near-end state to the controller when the residual amount of the solid lubricant reaches a first predetermined amount, outputs a second signal informing that the solid lubricant is in an end state to the controller when the residual amount of the solid lubricant reaches a second predetermined amount that is smaller than the first predetermined amount, outputs a third signal informing that the solid lubricant is in an absolute end state to the controller when the residual amount of the solid lubricant reaches a third predetermined amount that is smaller than the second predetermined amount, and wherein the controller is configured to:

temporarily stop the supplying operation of the lubricant supplier when the residual amount detector outputs the second signal, cancel a temporary stopped state of the lubricant supplier by a predetermined operation even when a replacement of the solid lubricant is not completed after the temporary stopped state, stop the supplying operation of the lubricant supplier when the residual amount detector outputs the third signal, and maintain a stopped state of the lubricant supplier until the replacement of the solid lubricant is completed after the stopped state.

15. The image forming apparatus according to claim 14, further comprising:

a counter that counts a running distance of the image bearer, and outputs a count value corresponding to the running distance to the controller, wherein the second predetermined amount corresponds to the residual amount when the count value counted by the counter reaches a first reference value, after the running distance of the image bearer when the residual amount of the solid lubricant reaches the first predetermined amount.

16. The lubricant supplying device according to claim 15, wherein the controller is configured to correct the first reference value based on the running distance, and wherein the running distance is between an initial use time of the solid lubricant and a timing of a state when the residual amount of the solid lubricant is detected as reaching the first predetermined amount.

17. The lubricant supplying device according to claim 16, wherein the controller is configured to increase the first reference value when the running distance is larger than a predetermined value, and decreases the first reference value when the running distance is smaller than the predetermined value.

18. The lubricant supplying device according to claim 14, further comprising:

a counter that counts a running distance of the image bearer, and outputs a count value corresponding to the running distance to the controller, wherein the third predetermined amount corresponds to the residual amount when the count value counted by the counter reaches a second reference value, after the running distance of the image bearer when the residual amount of the solid lubricant reaches the second predetermined amount.

19. The lubricant supplying device according to claim 18, wherein the controller is configured to correct the second reference value based on the running distance, and wherein the running distance is between an initial use time of the solid lubricant and a timing of a state when the residual amount of the solid lubricant is detected as reaching the first predetermined amount.

20. The lubricant supplying device according to claim 19, wherein the controller is configured to increase the second reference value when the running distance is larger than a predetermined value, and decreases the second reference value when the running distance is smaller than the predetermined value.

* * * * *